US010180006B2

(12) United States Patent
Haskell et al.

(10) Patent No.: US 10,180,006 B2
(45) Date of Patent: Jan. 15, 2019

(54) MAN-PORTABLE UNITARY AND INTEGRATED PLATFORM SYSTEMS AND SYSTEM SEGMENTS AND METHODS FOR EMPLOYING SYSTEM SEGMENTS

(71) Applicant: BATTLEMENT DEFENSE, LLC, Hailey, ID (US)

(72) Inventors: Nathaniel Hopkins Haskell, Hailey, ID (US); Michael Aaskov, Portland, OR (US); Michael Hunt, Woodstock, GA (US)

( * ) Notice: Subject to any disclaimer, the term of this patent is extended or adjusted under 35 U.S.C. 154(b) by 126 days.

(21) Appl. No.: 15/138,017

(22) Filed: Apr. 25, 2016

(65) Prior Publication Data

US 2016/0237701 A1 Aug. 18, 2016

Related U.S. Application Data

(63) Continuation-in-part of application No. 14/759,639, filed as application No. PCT/US2015/014107 on Feb. 2, 2015.

(51) Int. Cl.

| | |
|---|---|
| ***E04G 5/04*** | (2006.01) |
| ***E04G 3/20*** | (2006.01) |
| ***E04G 5/10*** | (2006.01) |

(52) U.S. Cl.

CPC ..... *E04G 3/20* (2013.01); *E04G 5/048* (2013.01); *E04G 5/10* (2013.01)

(58) Field of Classification Search

CPC .. E04G 5/041; E04G 5/04; E04G 5/06; E04G 5/046; E04G 2001/157; E04G 2001/158;

(Continued)

(56) References Cited

U.S. PATENT DOCUMENTS 530,349 A 12/1894 Payne
547,830 A 10/1895 Yates (Continued)

OTHER PUBLICATIONS

International Search Report for PCT/US2015/014107 dated May 14, 2015.
Written Opinion for PCT/US2015/014107 dated May 14, 2015.

*Primary Examiner* — Daniel P Cahn
(74) *Attorney, Agent, or Firm* — TannerIP PLLC; Daniel A. Tanner, III; James E. Golladay, II

(57) ABSTRACT

A system and method are provided for employing man-portable unitary platform system segments, particularly as components of integrated castle defense systems. A light-weight modular and mobile system of integrated platform segments is provided to facilitate users integrating flexible platform configurations secured to existing wall structures to support myriad user tasks. Individual platform system segments can be autonomously employed, or can be linked together after being quickly attached to a wall, a structure, or another supporting surface by two users in minimal time. In law enforcement, security, military and/or paramilitary employment scenarios, individual platform system segments are emplaced, and linked together, to provide a unitary defensible position in a matter of minutes. An overall platform structure of a plurality of individual man-portable platform system segments provides operational and employment flexibility that was previously unattainable to bolster or boost defenses of a particular position against increasing, and increasingly agile, threats.

8 Claims, 9 Drawing Sheets

(58) Field of Classification Search
CPC .... E04G 3/20; E04G 3/00; E04G 3/22; E04G 3/28; E04G 5/007; E04G 5/048; E04G 5/062; E04G 5/14; E04G 5/147; E04G 7/24
USPC ..... 182/82, 150
See application file for complete search history.

(56) References Cited

U.S. PATENT DOCUMENTS

| | | | | |
|---|---|---|---|---|
| 2,033,497 | A | 3/1936 | Victor | |
| 2,882,101 | A | 4/1959 | Michalak et al. | |
| 3,065,964 | A | 11/1962 | Barnes | |
| 4,029,173 | A | 6/1977 | Wakabayashi | |
| 4,074,792 | A | 2/1978 | Zaugg et al. | |
| 4,079,813 | A | 3/1978 | Ellison | |
| 4,320,816 | A | 3/1982 | Callahan et al. | |
| 4,799,447 | A | 1/1989 | Hebert et al. | |
| 4,907,674 | A | 3/1990 | Miller | |
| 4,911,264 | A | 3/1990 | McCafferty | |
| 4,971,169 | A | 11/1990 | Fruth | |
| 5,107,959 | A | 4/1992 | Lubinski | |
| 5,133,429 | A | 7/1992 | Densley | |
| 5,170,719 | A | 12/1992 | Pestone | |
| 5,503,358 | A | 4/1996 | Lapp | |
| 5,524,727 | A | 6/1996 | Yennie, Jr. | |
| 5,579,866 | A | 12/1996 | Rowell | |
| 5,653,178 | A | 8/1997 | Huczka | |
| 5,829,549 | A | 11/1998 | Flynn | |
| 6,053,280 | A * | 4/2000 | Smith | E04G 3/20 182/82 |
| 6,494,291 | B2 | 12/2002 | Ono | |
| 6,840,350 | B2 | 1/2005 | Deal | |
| 8,047,330 | B1 | 11/2011 | English | |
| 2006/0027726 | A1 | 2/2006 | Keith | |
| 2006/0131107 | A1 | 6/2006 | Duguay | |
| 2006/0163001 | A1 | 7/2006 | Pozell | |
| 2006/0175130 | A1 | 8/2006 | Riley | |
| 2006/0243524 | A1 | 11/2006 | Jarrell | |
| 2007/0056799 | A1 | 3/2007 | Leidner | |
| 2009/0095567 | A1 | 4/2009 | Rinna | |
| 2009/0223743 | A1 | 9/2009 | Jejina | |
| 2010/0032235 | A1 | 2/2010 | Barendregt | |
| 2010/0108441 | A1 * | 5/2010 | Morelli | E04G 3/28 182/82 |
| 2011/0012000 | A1 | 1/2011 | Bulley | |
| 2011/0120800 | A1 | 5/2011 | Depot | |
| 2012/0247872 | A1 | 10/2012 | Liu | |
| 2013/0048430 | A1 | 2/2013 | Preston | |
| 2014/0144724 | A1 | 5/2014 | St-Germain et al. | |
| 2014/0263516 | A1 | 9/2014 | Habberstad, Jr. et al. | |
| 2014/0360814 | A1 | 12/2014 | Panseri et al. | |
| 2015/0368914 | A1 | 12/2015 | Kurtz | |
| 2016/0083968 | A1 | 3/2016 | Brough | |
| 2016/0160513 | A1 | 6/2016 | Singh | |
| 2017/0096823 | A1 | 4/2017 | Apostolopoulas et al. | |

* cited by examiner

MAN-PORTABLE UNITARY AND INTEGRATED PLATFORM SYSTEMS AND SYSTEM SEGMENTS AND METHODS FOR EMPLOYING SYSTEM SEGMENTS

This application is a Continuation-in-Part of U.S. patent application Ser. No. 14/759,639, filed on Jul. 7, 2015, which, in turn, is a U.S. National Phase of International Application No. PCT/US2015/014107, filed in the US/RO on Feb. 2, 2015, the disclosures of which are hereby incorporated by reference herein in their entirety.

BACKGROUND

1. Field of the Disclosed Embodiments

This disclosure relates to systems and methods for providing and employing man-portable unitary platforms and platform system segments, particularly as components of integrated castle defense and battle defense systems.

2. Related Art

There continue to be increasing numbers of operating and employment scenarios in which stable structure-supported man-portable platforms may be effectively used. These scenarios include commercial employment with respect to many residential and commercial structures in support of such tasks as painting, pressure washing, and other structural construction and/or maintenance tasks. Moreover, these scenarios include emplacement of defensible positions for law enforcement, security, military and paramilitary operations.

Conventionally, as an example in battle defense employment scenarios, large-scale fortifications may be built according to a model that is generally referred to as a "Tower and Wall" configuration. In this conventional configuration, permanent or semi-permanent wall sections are typically erected between two permanent or semi-permanent defensible position towers. The tower and wall configuration may require combat construction, including heavy equipment employment to engineer the concrete fortifications that are at the center of the concept. A variation on this theme employs pre-fabricated mesh steel skeletons overcoated with some semi-permeable or impermeable fabric-type component as an outer skin to form individual constraining wall components. These wall components are unfolded and erected, and then filled with, for example, sand, available stones, or other like commonly-available materials.

Shortfalls in the conventional solutions include that they are manpower and equipment intensive, taking hours and often heavy support equipment to emplace. As such, they are comparatively expensive in requiring extensive time, money and specified materials for the formation of the defensible positions. The positions themselves tend also to be inflexible and generally afford no capacity for movement between different defensive positions along and between the walls of an in-place fortress structure. This tends to cause these positions to be restrictive in the ability of a defending force to respond to an agile threat capable of providing either increased force presentation along multiple axes of approach, or agility to adjust an axis of approach of an aggressor force toward a defensible position.

SUMMARY OF DISCLOSED EMBODIMENTS

In view of the above-specified shortfalls in conventional battle defense systems, it would be advantageous to provide systems and methods that are flexible enough to allow defenders to, for example, improve existing defenses in response to dynamic tactical situations. Properly configured, a flexible, easily configurable/re-configurable platform system of integrated modular components may provide significant advantages over conventional battlement products. Such platform systems may additionally find commercial utility in replacing the multiple disparate components that are currently used to form cumbersome ladder and scaffolding structures in support of structural manufacturing, remodeling and/or maintenance tasks.

Exemplary embodiments of the systems and methods according to this disclosure may provide a lightweight modular and mobile system of integrated platform segments that may facilitate users integrating flexible platform configurations secured to existing wall structures to support myriad user tasks.

Exemplary embodiments may provide man-portable platform system segments that can be autonomously employed, or can be linked together after being quickly attached to a wall, a structure, or another supporting surface by two users in minimal time.

In law enforcement, security, military and/or paramilitary employment scenarios, exemplary embodiments may be emplaced, and linked together, to provide a unitary defensible position in a matter of minutes. An overall platform structure of a plurality of individual man-portable platform system segments may provide operational and employment flexibility that was previously unattainable. In this manner, employment of the disclosed systems may easily bolster or boost defenses of a particular position against increasing, and increasingly agile, threats.

Exemplary embodiments may be adaptable for use with existing structures of all types without requiring separate combat construction of specifically adaptable structures.

In exemplary embodiments, the integrated design of the man-portable platform system segments may allow individual users to arrive at an employment site carrying only the integrated structure with everything that is required for stable placement and use of the structure to a number of advantageous operational scenarios, i.e., no other tools being required for emplacement and employment. In embodiments, support points, connecting points, and ancillary equipment (and connections for that ancillary equipment to the individual platform system segments) may be of standardized configurations to facilitate ease of use with a full spectrum of supporting and/or supported compatible components.

In embodiments, the integrated (and self-contained) nature of the deployable structure is enhanced by providing that all of the required structural components are cooperatively integrated in a manner that reduces a number of loose components.

In embodiments, a unique self-attaching hook device component is provided for engagement of the individual platform system segments with structures of varying thicknesses. In embodiments, the unique self-attaching hook device component is configured to provide an enhanced degree of positive engagement of each individual platform system segment with the structure with which the platform segment is engaged.

Exemplary embodiments may provide a holistic system for easy emplacement where walls exist but no (or limited) defensible positions are provided.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for providing and employing man-portable unitary platforms and platform system segments, particularly as components of integrated castle defense and battle defense systems, will be described, in detail, with reference to the following drawings, in which.

DETAILED DESCRIPTION OF THE DISCLOSED EMBODIMENTS

Figure 1:
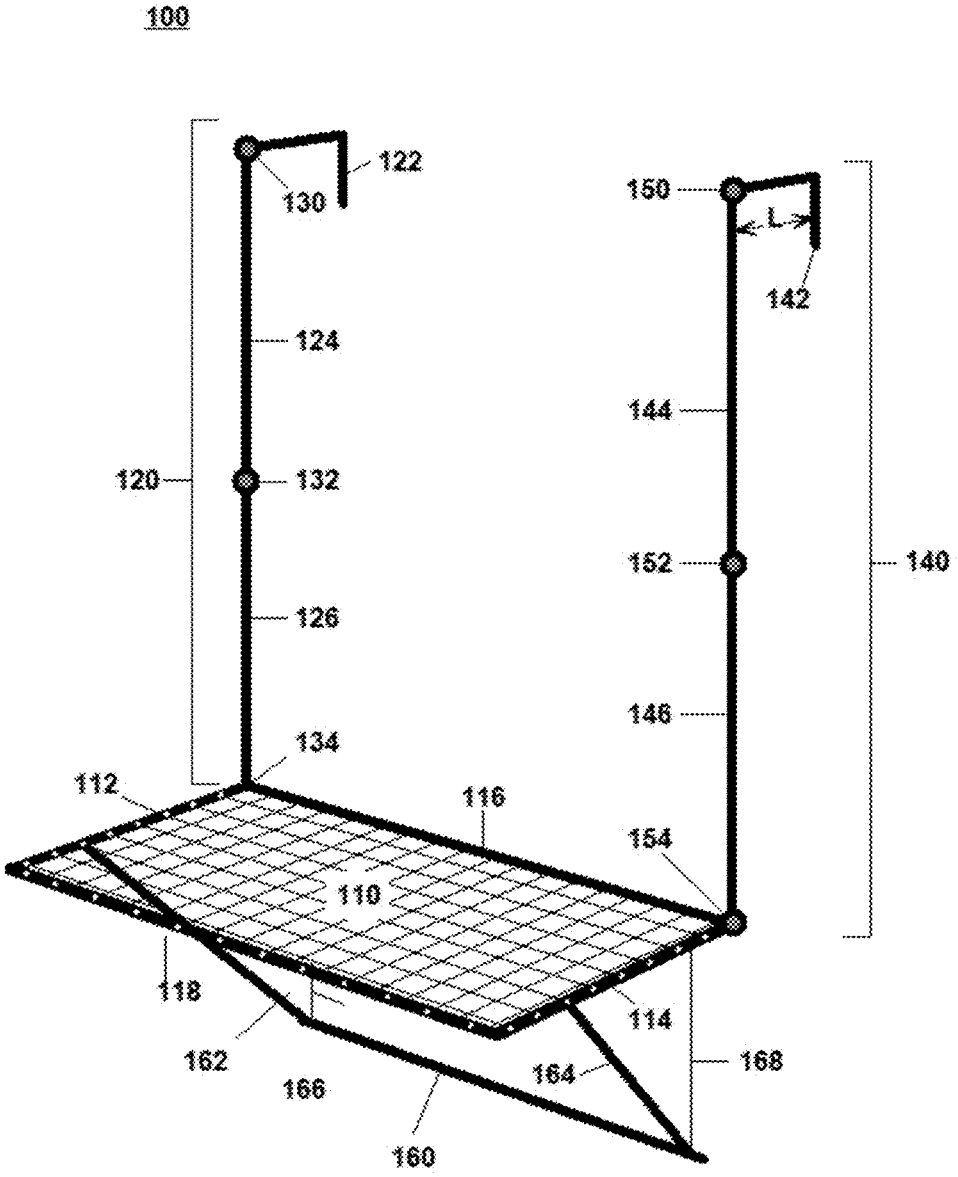
FIG. 1 illustrates a perspective view of an exemplary embodiment of a man-portable integrated and unitary platform system segment according to this disclosure as it would be deployed for use.

The systems and methods for providing and employing man-portable unitary platforms, platform systems and platform system segments, particularly as components of integrated castle defense and battle defense systems according to this disclosure, will generally refer to this specific utility for those systems and methods. Exemplary embodiments described and depicted in this disclosure should not be interpreted as being specifically limited to any particular configuration of the depicted platform system segments, or to any particular operational or employment scenario for such platform system segments. Any advantageous configuration and/or use of a man-portable unitary platform system segment employing components, devices, systems, techniques, methods and/or schemes such as those discussed in detail in this disclosure is contemplated. The disclosed schemes may be applicable, for example, to law enforcement, security, military and/or paramilitary employment scenarios in which defensible positions may be erected and maintained, or static offensive positions may be erected and maintained in support of the operational objectives of the employing entities.

Specific reference to, for example, any particular structural element, component or unit configuration, including but not limited to, configurations of the platform, the platform frame, the upright (hanging) elements, the multiple configurations of the underlying stabilizing and support structure, locking components (including mechanical locking pins) for locking elements in particular configurations relative to one another (where appropriate) and/or myriad standard components for supporting, or being supported by, the man-portable unitary platform system segment, as described and depicted below, and generally throughout this disclosure, should be understood as being exemplary only, and not limiting, in any manner, to any particular class of such components, materials for manufacturing such components, or configurations of such components. The systems and methods according to this disclosure will be described as being particularly adaptable to providing comparatively easily-emplaced platform structures for use in a castle-defense scenario as that term is generally understood by military and paramilitary professionals and operators worldwide. These references are meant to be illustrative only in providing a single real-world utility for the disclosed systems and methods, and should not be considered as limiting the disclosed systems and methods to only certain operating scenarios while discounting, for example, standard commercial applications or such platform system segments. Virtually any operating or employment scenario that may benefit from the provision of a lightweight, integrated structure-supported platform system that may benefit from the disclosed configurations, schemes and/or techniques, and reasonable variations thereof, is contemplated as being encompassed within the spirit and scope of this disclosure.

This disclosure is directed to systems and methods by which pairs of users, and in configurations, individual users, may transport platform system segments to an employment site. Once at the employment site, the integrated configuration of the platform system segment may provide the pair of users, or individual user where appropriate, everything that is needed to configure and place the platform system segment on an existing support structure with no requirement for additional components, as all of the elements for placement, stabilization and use may be parts or components of the single integrated structure that is the individual man-portable unitary platform system segment.

The disclosed schemes may provide a lightweight, mobile and modular platform that may easily be emplaced by two operators, or in certain configurations, a single operator, in less than two minutes with all of the elements that are required for security, safety and operational employment of the platform once in place. The disclosed schemes may provide a standard configuration of support and/or connecting points that allow for easy connection of a plurality of platform system segments employing only standardized component configurations and/or standardized connecting pin components to minimize any requirement for additional "pieces" or tools. In embodiments, no "loose" pieces are provided. It is anticipated that, for example, to emplace the walkway according to the disclosed schemes along an entire structure that encloses an area the size of a football field may employ as many as 180 individual platform segments, free hanging and/or connected together in manageable groups or subsets.

The disclosed schemes may provide, for example, a system of mounts for matching existing support and/or defense equipment with existing walls at an employment site. Such existing support and/or defense equipment may include, but not be limited to, machine gun mounts. Long Range Acoustic Device (LRAD) mounts, ballistic armor panels, storage baskets (for, for example, supplies, ammunition and/or provisions storage), razor wire, sniper shields, environmental coverings, stools, steps, ladders, safety rails, safety tethers/straps and the like.

FIG. 1 illustrates a perspective view of an exemplary embodiment of a man-portable integrated and unitary platform system segment 100 according to this disclosure as it would be deployed for use.

As shown in FIG. 1, the exemplary platform system segment 100 may include a framed platform element 110. The framed platform element 110 may include side frame components 112,114 along either side of the framed platform element 110 with a structure facing frame component 116 and a structure-opposite frame component 118. Each of at least the side frame components 112,114 and the structure-opposite frame component 118 may include, space at regular intervals, structural openings (see the white dots in FIG. 1) for accommodating connecting elements and components, which may include, for example, mechanical retaining pins, e.g., spring pins, cotter key pins, or other like known structural pin-type connecting components.

The exemplary platform system segment 100 may include, on each side, articulated platform hanging hook components 120,140. Each articulated platform hanging hook component 120,140 may be comprised of a structural engagement hook element 122,142. Each structural engagement hook element 122,142 may be integrally formed with an upper upright hanger component 124,144 of the respective platform hanging hook components 120,140. Alternatively, each structural engagement hook element 122,142 may be engaged with the respective upper upright hanger component 124,144 via an intervening mechanical member 130,150, respectively. The intervening mechanical member 130,150 may be in a form of an articulated joint to provide additional flexibility in the placement of the structural engagement hook elements 122,142 with respect to the supporting structure. Alternatively, or additionally, the intervening mechanical member 130,150, may be in a form of a mechanical component, for example, a screw device, by which a horizontal distance L between a vertical portion of the engagement hook element 142 and the respective upper upright hanger component 144 may be adjusted, or otherwise modified, for flexibility, safety and security in attachment of the exemplary platform system segment 100 to different structures and/or structural attachment points.

Each of the articulated platform hanging hook components 120,140 may be further comprised of a lower upright hanger component 126,146 respectively connected to the upper upright hanger component 124,144 at an articulated mechanical joint 132,152. In turn, each of the articulated platform hanging hook components 120,140 may be connected to the framed platform element 110 via an articulated mechanical joint 134,154 emplaced between the lower upright hanger component 126,146 and a respective side frame component 112,114 of the framed platform element 110. Each of the articulated mechanical joints 132,134,152,154 may be configured in a manner to articulate only in a single articulating direction to facilitate folding of the articulated platform hanging hook component 120,140 with respect to the framed platform element 110 (see FIGS. 3-5). In embodiments, each of the articulated mechanical joints 132,134,152,154 may be configured to provide unimpeded mechanical movement in the single articulating direction. In other embodiments, the articulated mechanical joints 132,134,152,154 may be configured to provide additional degrees of freedom in them or in the movement of the components they connect, and/or to provide additional mechanical devices, such as, for example, screw-type devices that may be usable to impede a freedom of movement between the components that the articulated mechanical joints 132,134,152,154 connect and/or to lock those components in place, for example, in an operating configuration such as that shown in FIG. 1 or a transport (stowed) configuration such as that shown in FIG. 4. In embodiments, at least the middle articulated mechanical joints 132,152 may be configured in a manner that allows an adjustment of an overall extended length of the platform hanging hook components 120,140 by providing a capacity by which to be slid along and/or secured to other than an end of one or more of the upper/lower upright hanger components 124,126,144,146, respectively.

To provide appropriate stability, security, and weight-bearing capacity for the framed platform element 110 in operation hanging from a structure, a stabilizing element may be provided. The stabilizing element may comprise a structure engaging portion 160 and a pair of stabilizing legs 162,164. The stabilizing legs 162,164 may be secured to the framed platform 110 via the mechanical pin-type components described above protruding through appropriate ones of the physical openings in the side frame components 112,114. In order to ensure proper placement and stability, the stabilizing element may include one or more vertical elements 166,168, which may be in the form of solid structures, cables, chains or the like that may control placement of the stabilizing element with respect to the framed platform element 110. The individual components making up the stabilizing element may be permanently affixed to one another, or may be affixed to one another in operation via some mechanical interconnection including, for example, being screwed together or otherwise being accommodated in fitted openings in the various components to facilitate easily being put together and taken apart. It is anticipated that all of the elements of the parts of the stabilizing element will be accommodated in the exemplary platform system segment 100 in its transport (stowed) configuration in order that all of the elements necessary for construction and emplacement of the exemplary platform system segment 100 will the available to the user as a complete package when the user(s) arrive carrying the exemplary platform system segment 100 at the employment site.

Figure 2:
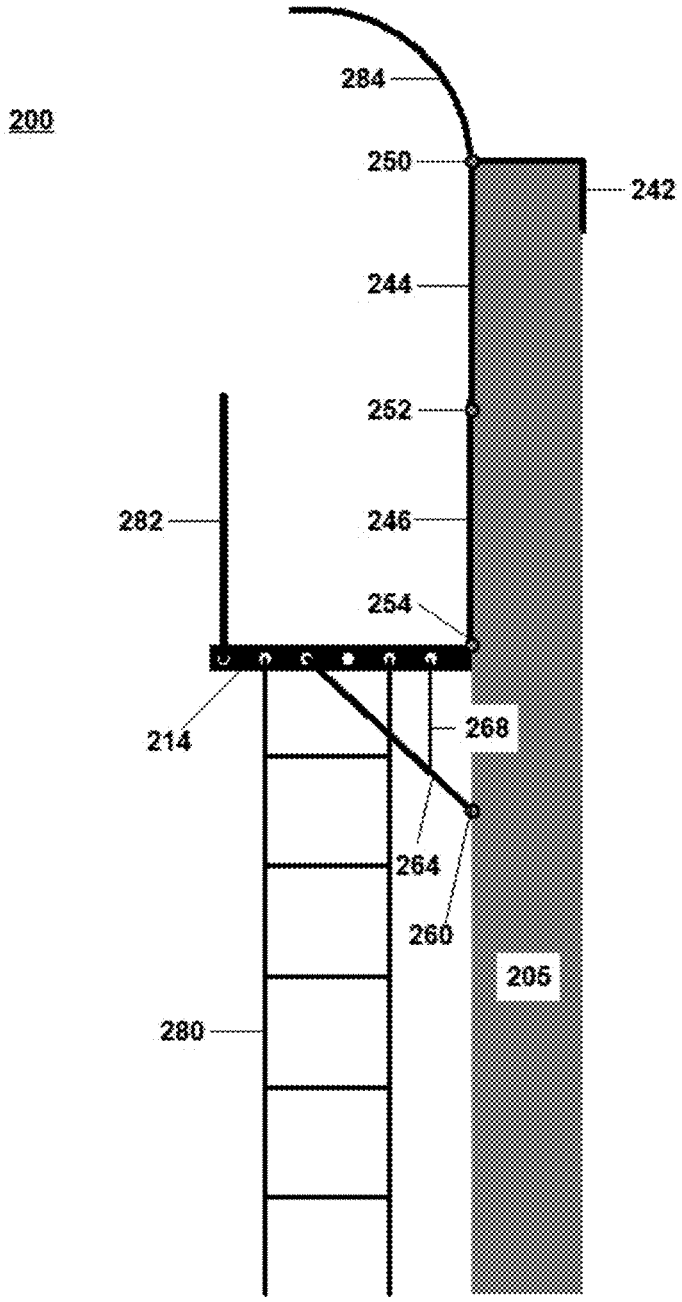
FIG. 2 illustrates a side view of an exemplary embodiment of a man-portable integrated and unitary platform system segment deployed for use in contact with a supporting structure, including certain additional system components for use with the platform system segment, according to this disclosure.

FIG. 2 illustrates a side view of an exemplary embodiment of a man-portable integrated and unitary platform system segment 200 deployed for use in contact with a supporting structure 205, including certain additional system components (which will be described in greater detail below) for use with the exemplary platform system segment 200, according to this disclosure. Note that similar elements in each of the figures are similarly numbered.

The exemplary platform system segment 200 is shown mounted to the supporting structure 205 with the various elements of the articulated platform hanging hook components generally in contact with the supporting structure 205. These elements include the structural engagement hook element 242, intervening mechanical member 250, the upper upright hanger component 244, the articulated mechanical joint 252, the lower upright hanger component 246, and the articulated mechanical joint 254. A structure facing frame element (not shown) of the framed platform element is also in contact with the support structure, as is a structure engaging portion 260 of the stabilizing element held in place by stabilizing leg 264 and vertical element 268.

FIG. 2 illustrates a cross-section of the myriad additional system components for use with the exemplary platform system segment 200. Connection of a number of these elements to the exemplary platform system segment 200 may be via the structural openings that are spaced at regular intervals in the frame components of the framed platform element (see the white dots side frame element 214 in FIG. 2). Others of these elements may be mechanically connected to other portions of the exemplary platform system segment 200 in a similar manner or via other standard similar mechanical devices. As examples of the additional system components for use with the exemplary platform system segment 200 shown in FIG. 2, are (1) an accommodating ladder 280, which may be replaceable by, for example, steps or a stool or other like device; (2) a safety barrier 282, which may be in the form of, for example, safety rail or a ballistic armor panel or both; and (3) a shield element 284, which may be in a form of a sniper shield or simply provided as an element for limiting exposure to environmental elements including weather, sunlight, sandstorms and the like.

Figure 3:
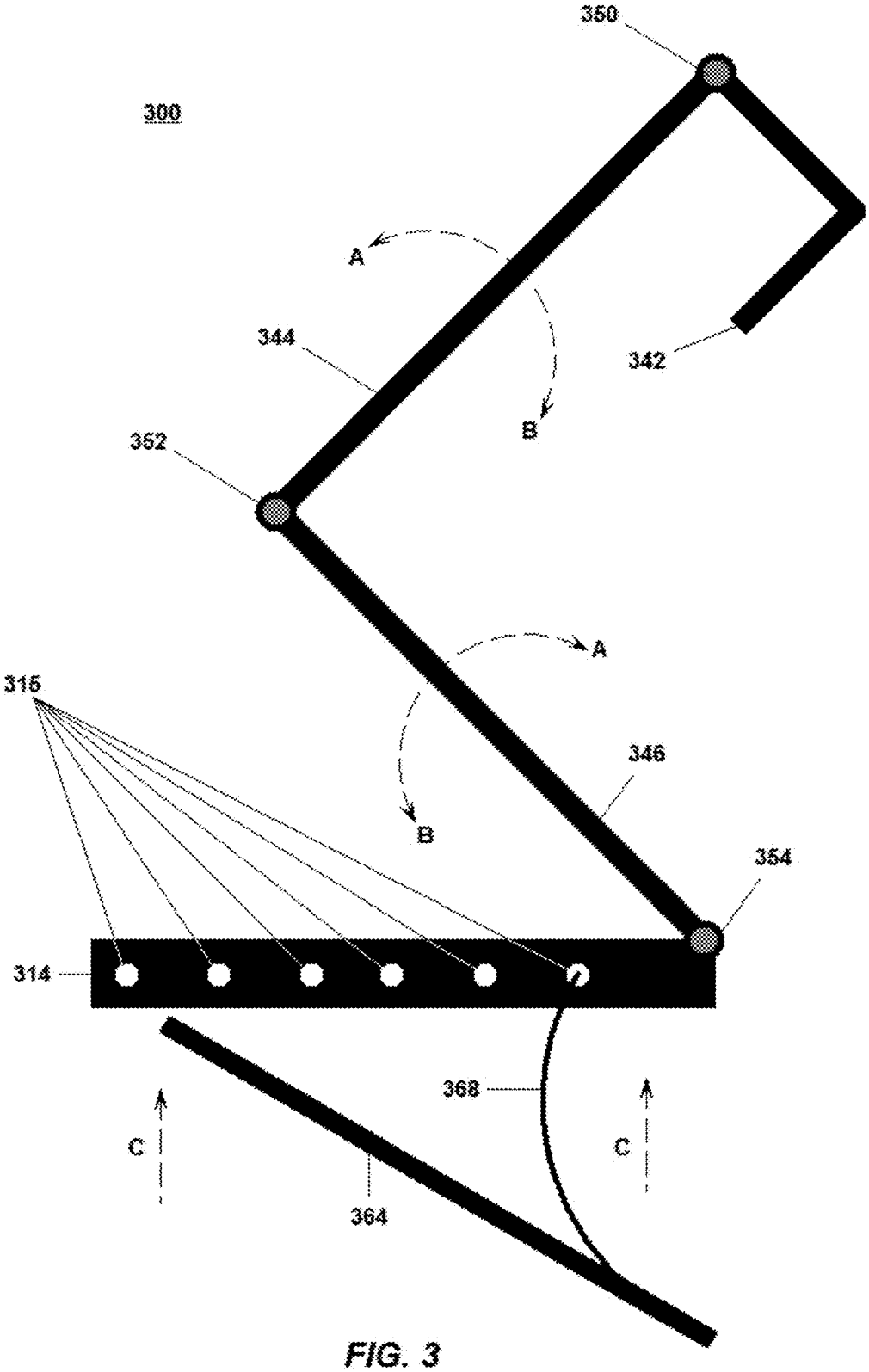
FIG. 3 illustrates a side view of an exemplary embodiment of a man-portable integrated and unitary platform system segment in transition between a transport (stowed) configuration and an operating (open) configuration according to this disclosure.

FIG. 3 illustrates a side view of an exemplary embodiment of a man-portable integrated and unitary platform system segment 300 in transition between a transport (stowed) configuration (see FIG. 4) and an operating (open) configuration (see FIGS. 1 and 2) according to this disclosure.

The exemplary platform system segment 300 may be folded and unfolded as shown in FIG. 3. The articulated platform hanging hook components including the engagement hook element 342 and intervening mechanical member 350 along with the upper upright hanger component 344 may be folded by being rotated in direction B about the articulated mechanical joint 352 while the lower upright hanger component 346 is being similarly rotated in direction B about the articulated mechanical joint 354. Unfolding the components involves rotating each of the portions in the opposite direction (direction A shown in FIG. 3). Additionally, during the folding operation, the stabilizing leg 364 of the stabilizing element may be removed from its attachment point at one of the structural openings 315 in the side frame element 314 of the framed platform element. In embodiments in which the vertical component 368 of the stabilizing element is flexible, the attachment of the particle component 368 to the side frame element 314 and to the stabilizing leg 364 may be maintained while the stabilizing element is stowed in a bottom of the framed platform element in direction C.

Figure 4:
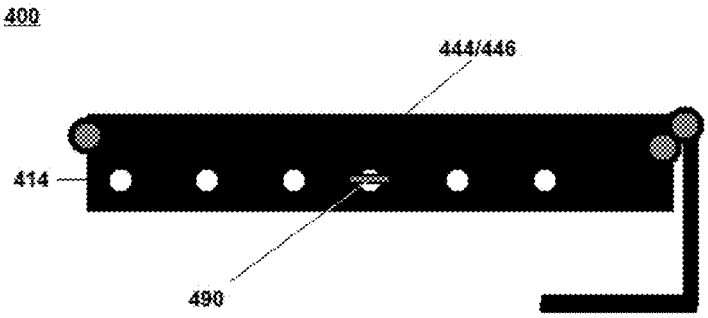
FIG. 4 illustrates a side view of an exemplary embodiment of a man-portable integrated and unitary platform system segment in a transport (stowed) configuration according to this disclosure.

FIG. 4 illustrates a side view of an exemplary embodiment of a man-portable integrated and unitary platform system segment 400 in a transport (stowed) configuration according to this disclosure. As shown in FIG. 4, the upper upright hanger component 444 and the lower upright hanger component 446 are folded to their transport (stowed) configuration to be essentially in a side profile of the side frame element 414 of the framed platform element. In this configuration, the upper/lower upright hanger components 444/446 may be secured in place by a mechanical pin type structure 490.

Figure 5:
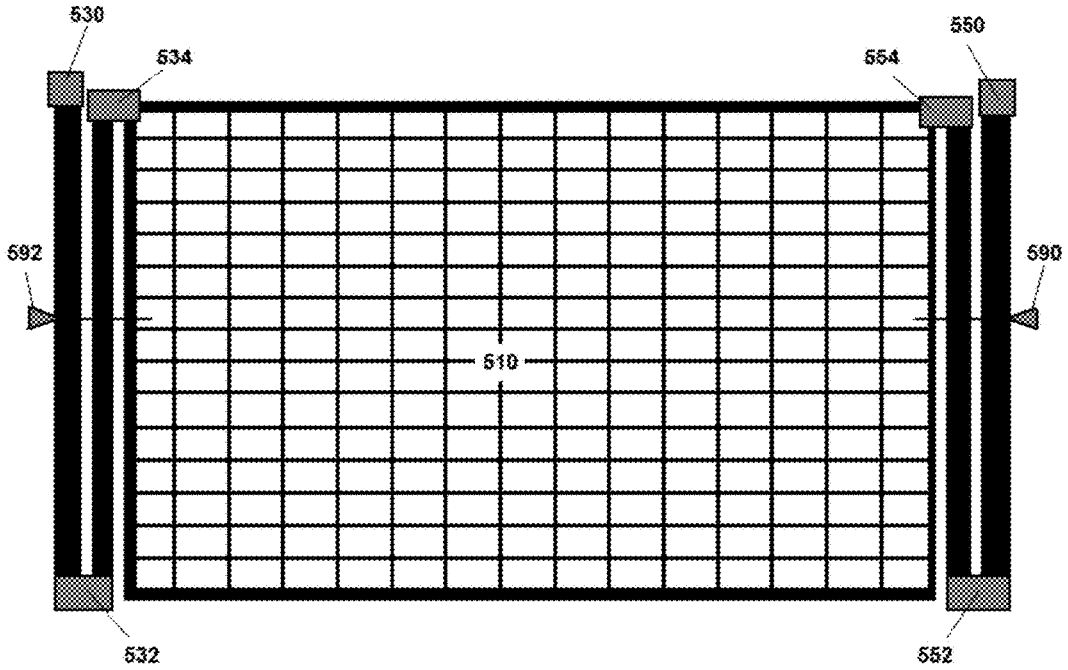
FIG. 5 illustrates a top view of an exemplary embodiment of a man-portable integrated and unitary platform system segment in the transport (stowed) configuration according to this disclosure.

FIG. 5 illustrates a top view of an exemplary embodiment of a man-portable integrated and unitary platform system segment 500 in the transport (stowed) configuration according to this disclosure. As shown in FIG. 5, the structural elements of the articulated platform hanging hook components are shown having been rotated about the intervening mechanical members 530,550 and the articulated mechanical joints 532,534,552,554, and are secured by the mechanical pin-like components 590,592 to either side of the frame of the framed platform element 510.

Figure 6:
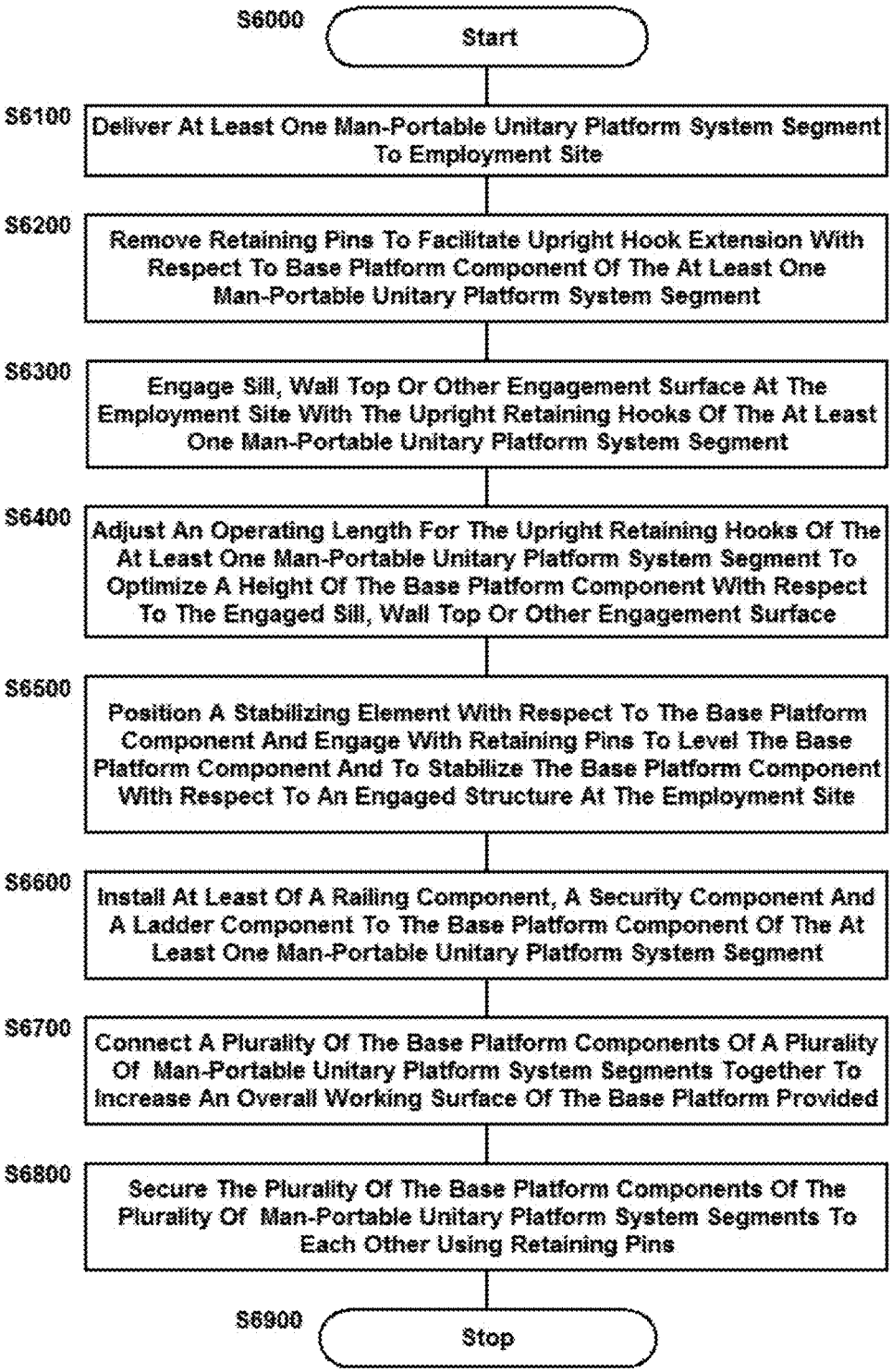
FIG. 6 illustrates a flowchart of an exemplary method for effecting operational emplacement of a man-portable integrated and unitary platform system segment in an operating configuration according to this disclosure.

The disclosed embodiments may include an exemplary method for effecting operational emplacement of a man-portable integrated and unitary platform system segment in an operating configuration. FIG. 6 illustrates a flowchart of such an exemplary method. As shown in FIG. 6, operation of the method commences at Step S6000 and proceeds to Step S6100.

In Step S6100, at least one man-portable unitary platform system segment may be delivered to an employment site. In the disclosed configurations, it is anticipated that the at least one man-portable unitary platform system segment will be comparatively easily man transportable by no more than two users. Operation of the method proceeds to Step S6200.

In Step S6200, retaining pins, which may be placed to hold the upright hook extension components in their transport (stowed) position may be removed to facilitate upright hook extension with respect to the base platform component on the at least one man-portable unitary platform system segment. The retaining pins, when included, may be attached, for example, by cables to the frame of the base platform component in order that all of the parts and/or elements of the at least one man-portable unitary platform system segment remain attached to one another for transport, assembly and employment. Operation of the method proceeds to Step S6300.

In Step S6300, one or more users may elevate the base platform component of the at least one man-portable unitary platform system segment in order that extended upright hook extension components may be used to engage at least one of a sill, a wall top or other similar engagements surface at the employment site. Operation of the method proceeds to Step S6400.

In Step S6400, an operating length of the upright retaining hooks of the at least one man-portable unitary platform system segment may be adjusted to optimize a height of the base platform component with respect to the engaged still, wall top or other similar engagement surface. In embodiments, the operating length of the upright retaining hooks may be fixed. Operation of the method proceeds to Step S6500.

In Step S6500, a stabilizing element may be positioned with respect to the base platform component to level and stabilize the base platform component with respect to the engaged structure at the employment site. In alternative embodiments, stabilizing elements may be fixed to one of the lower portion of the upright retaining hooks, or the platform, and may slidably engage the other one of the lower portion of the upright retaining hooks or the platform via a channel in which a slidable component is made to a but a stop at the end of the channel 1 the upright retaining hooks and the platform are substantially in a position 90° with respect to each other for use. Operation of the method proceeds to Step S6600.

In Step S6600, at least one of a railing component, a security component and a ladder component may be installed to the base platform component of the at least one man-portable unitary platform system segment. Such attachment may be by using, for example, additional retaining pins to attach the various components to the side frames of the base platform component. In embodiments, at least one railing component may be rotatably engaged at one end to the base platform components as a part of the integral structure in the same manner that the upright retaining hooks are rotatably engaged to the base platform components. Operation of the method proceeds to Step S6700.

In Step S6700, a plurality of base platform components may be connected together to increase an overall working surface of the base platform provided. Operation of the method proceeds to Step S6800.

In Step S6800, the plurality of base platform components may be secured to one another using retaining pin components. Operation of the method proceeds to Step S6900, where operation of the method ceases.

Figure 7:
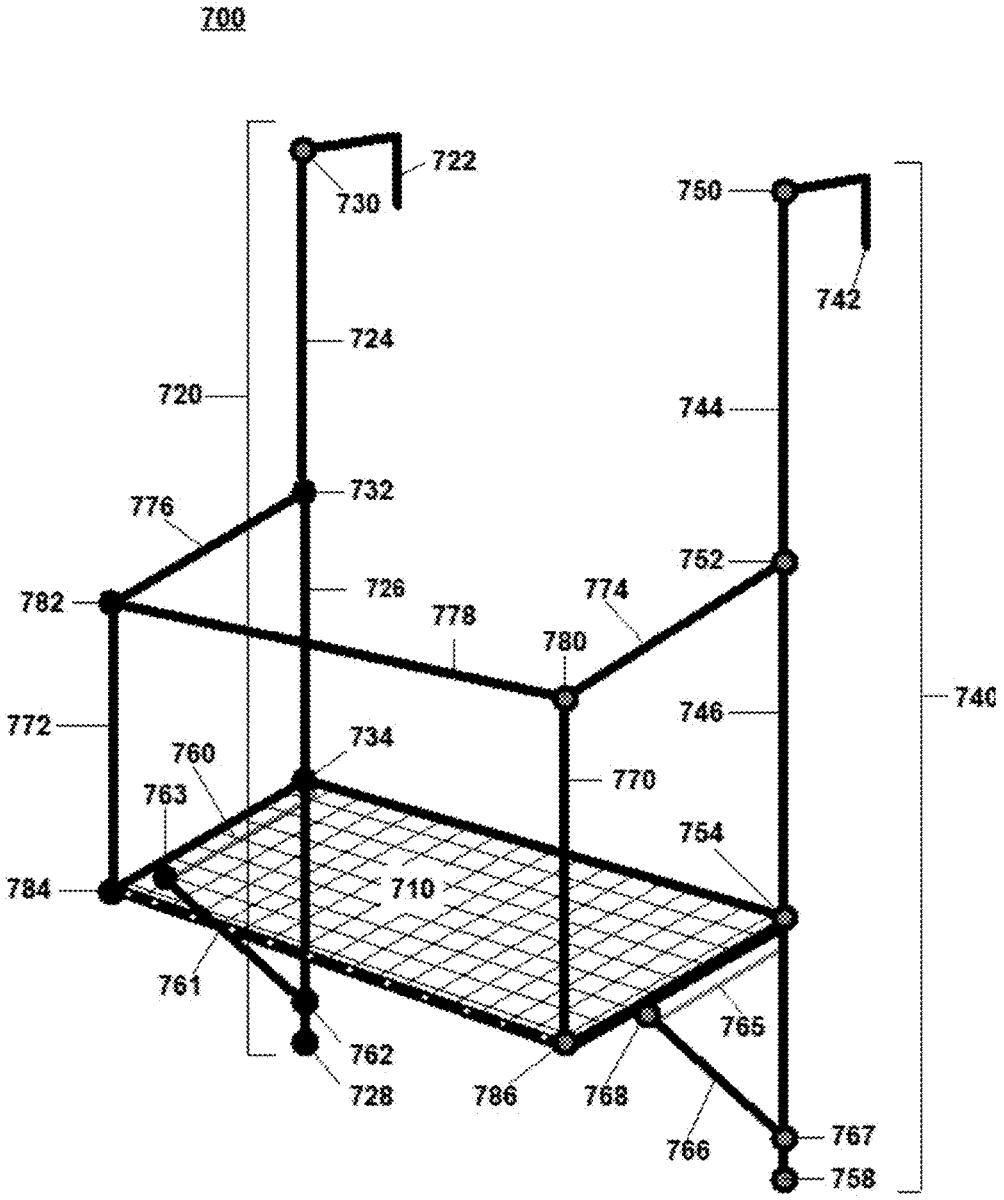
FIG. 7 illustrates a perspective view of an exemplary alternative embodiment of a man-portable integrated and unitary platform system segment according to this disclosure as it would be deployed for use.

FIG. 7 illustrates a perspective view of an exemplary alternative embodiment of a man-portable integrated and unitary platform system segment 700 according to this disclosure as it would be deployed for use.

As shown in FIG. 7, in like manner to the configuration of the exemplary embodiment shown in FIG. 1, the exemplary platform system segment 700 may include a framed platform element 710. Each of opposing lateral side frame components may have associated with it, as an integral structure or otherwise, and engaging slot 760,765, for engaging a slidable structural component 763,768 positioned at one and of a support leg 761,766, an other end of each of the support legs 761,766, being rotatably engaged with other structural components in a manner that will allow the framed platform element 710 to be appropriately supported in use. Details of the structural engagement of the support legs 761,766 will be described in greater detail below with reference to, for example, FIGS. 8 and 9.

The exemplary platform system segment 700 may include, on each side, extended platform hanging hook components 720,740. Each extended platform hanging hook component 720,740 may be comprised in a generally similar manner to the articulated platform hanging hook components 120,140 shown in FIG. 1. In separate embodiments, each of the extended platform hanging hook components 720,740, rather than being articulated and foldable about substantially a midpoint, may have a telescoping-type extendible structure. Each of the extended platform hanging hook components 720,740 may include a structural engagement hook element 722,742. Each structural engagement hook element 722,742 may be integrally formed with an upper upright hanger component 724,744 of the respective extended platform hanging hook components 720,740. Alternatively, each structural engagement hook element 722,742 may be engaged with the respective upper upright hanger component 724,744 via an intervening mechanical member 730,750, respectively, or according to a pre-determined, or field enabled mechanical interconnection as will be described in greater detail below with reference to FIG. 10. When present, the intervening mechanical member 730, 750 may be in a form of an articulated joint to provide additional flexibility in the placement of the structural engagement hook elements 722,742 with respect to the supporting structure, or may be according to any other mechanical interconnecting means.

Each of the extended platform hanging hook components 720,740 may be further comprised of a lower upright hanger component 726,746 respectively connected to the upper upright hanger component 724,744 at an articulated mechanical joint 732,752, in general in a same manner as shown in FIG. 1 for the respective elements. In separate embodiments, each of the extended platform hanging hook components 720,740 may be otherwise comprised of a lower upright hanger component 726,746, from which the respective upper upright hanger component 724,744 may be telescopically extended.

A notable difference in the configuration according to FIG. 7, over that shown in FIG. 1, is that the respective lower upright hanger components 726,746 in the operating (open) configuration as shown extend below the framed platform element 710 in order to be integral components of the underlying support structure. In turn, each of the extended platform hanging hook components 720,740 may be connected to the framed platform element 710 via an articulated mechanical joint 734,754 emplaced between the lower upright hanger component 726,746 and a respective side frame component of the framed platform element 710. Each of the lower upright hanger components 726,746 may include one or more fixed attachment points for the support legs 761,766 as a mechanical joint 728,758 at a lower distal end of the lower upright hanger component 726,746, or at some intermediary position for a mechanical joint 762,767 between the framed platform element 710 and the lower distal end of the lower upright hanger component 726,746. Each of the articulated mechanical joints 732,734,752,754, may be configured in a manner to articulate only in a single articulating direction to facilitate folding of the extended platform hanging hook component 720,740 with respect to the framed platform element 710 (see, e.g., FIGS. 4,5, 8 and 9). In embodiments, each of the articulated mechanical joints 732,734,752,754 may be configured according to any of the alternatives described above with respect to the corresponding articulated mechanical joints shown in FIG. 1.

In the embodiment shown in FIG. 7, integral railing components may be provided. Connections between the railing uprights 770,772 and the framed platform element 710 may be according to articulated mechanical joints 784,786, respectively. In a like manner, connections between the railing uprights 770,772 and the side rails 774,776 may be according to articulated mechanical joints 780,782, respectively. The side rails 774,776 may be configured to engage the articulated mechanical joints 752, 732 appropriately to complete the formation of the side rails. In separate embodiments, the side rails 774,776 may be configured to mechanically engage the extended platform hanging hook components 720,740 appropriately at positions other than the articulated mechanical joints 752, 732 to complete the formation of the side rails 774,776. A separate back railing component 778 may be provided, which may be configured to appropriately engage articulated mechanical joints 780,782 completing the structure of the integral railing components in the manner shown in FIG. 7.

As mentioned above, different from the configuration shown in FIG. 1, in order to provide appropriate stability, security, and weight-bearing capacity for the framed platform element 710 in operation stabilizing elements as discussed briefly above may be provided. Detailed discussion regarding these stabilizing elements in operation will be provided below with reference to FIGS. 8 and 9.

Figure 8:
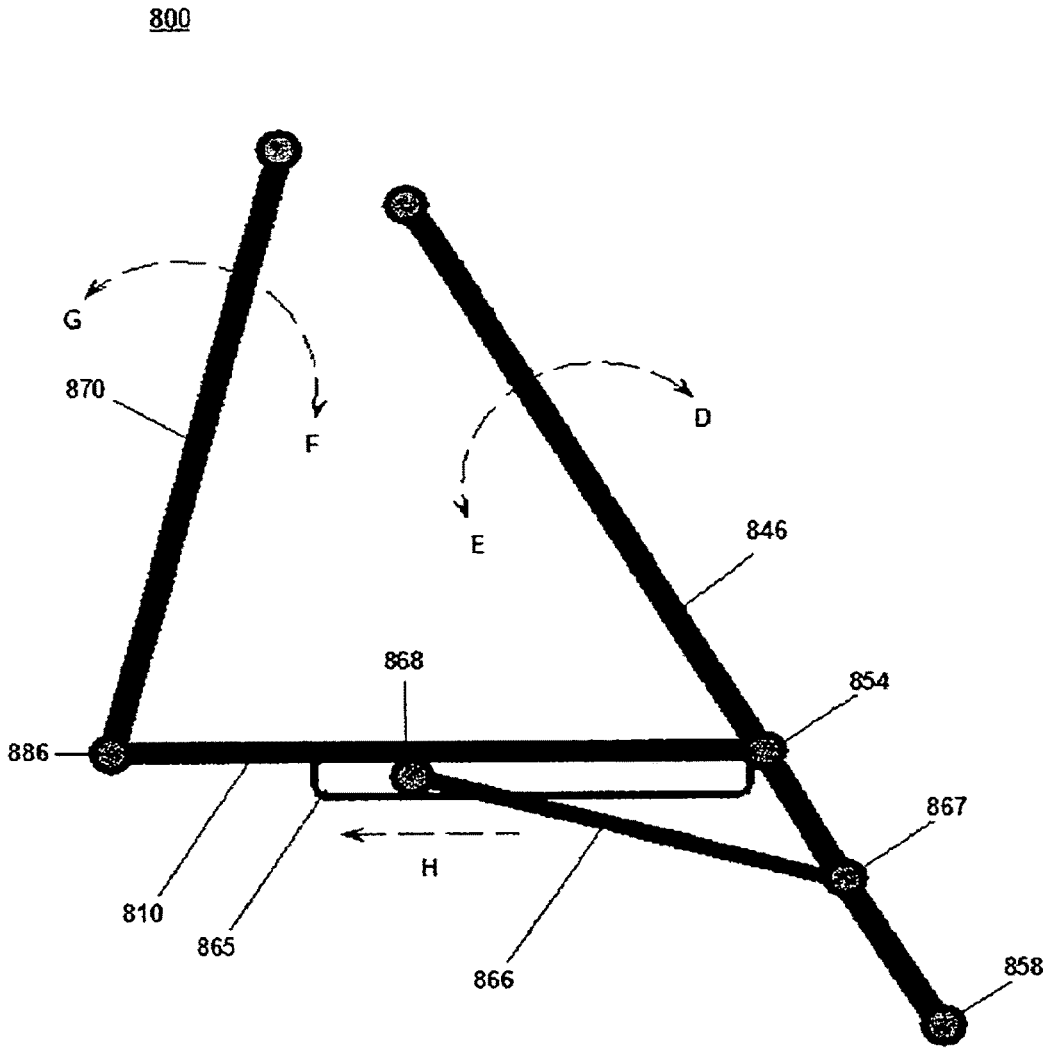
FIG. 8 illustrates a side view of a first configuration of a lower portion of the exemplary alternative embodiment of the man-portable integrated and unitary platform system segment shown in FIG. 7 in transition between a transport (stowed) configuration and an operating (open) configuration according to this disclosure.

FIG. 8 illustrates a side view of a first configuration 800 of a lower portion of the exemplary alternative embodiment of the man-portable integrated and unitary platform system segment shown in FIG. 7 in transition between a transport (stowed) configuration and an operating (open) configuration according to this disclosure.

The first configuration 800 may allow the man-portable integrated and unitary platform system segment to be folded and unfolded as shown in FIG. 8. Upper portions of the extended platform hanging hook components may be in a similar configuration to those shown in FIGS. 1 and 3, or may be in a configuration to extend telescopically from respective lower upright hanger components, and are omitted in FIG. 8 for clarity.

The man-portable integrated and unitary platform system segment may be unfolded and folded by rotating, for example, the lower upright hanger component 846 respectively in directions D or E around the articulated mechanical joint 854 with respect to the framed platform element 810, as appropriate. In a similar manner, the railing upright 870 may be folded and unfolded by rotating it in directions F and G around the articulated mechanical joint 886 with respect to the framed platform element 810, as appropriate.

A lateral side frame component of the framed platform element 810 may be configured with an integral slot-type structure 865 that may be engaged by a slidable structural component 868 at one and of a support leg 866. The other end of the support leg 866 may be engaged with the lower upright hanger component 846 by means of an interconnecting structure 867, which may be in the form of another articulated mechanical joint. In embodiments, the interconnecting structure 868 may be at an appropriate intervening position between the articulated mechanical joint 854 and a distal end 858 of the lower upright hanger component. The support leg 866 may be appropriately, or adjustably, sized to abut an end of the integral slot-type structure 865, after translating in direction H as the lower upright hanger component 846 is unfolded in direction D with respect to the framed platform element 810. Unlike the embodiment shown in FIG. 3, the configuration shown in FIG. 8 reduces a number of "loose" pieces, i.e., locking pins, that may have been otherwise necessary to properly position the support structure. In embodiments, a similar support structure may be appropriately configured in which the support leg 866 is configured to engage the integral slot-type structure 865 from above the framed platform element 810 in a configuration as a hanging component rather than a support leg.

Figure 9:
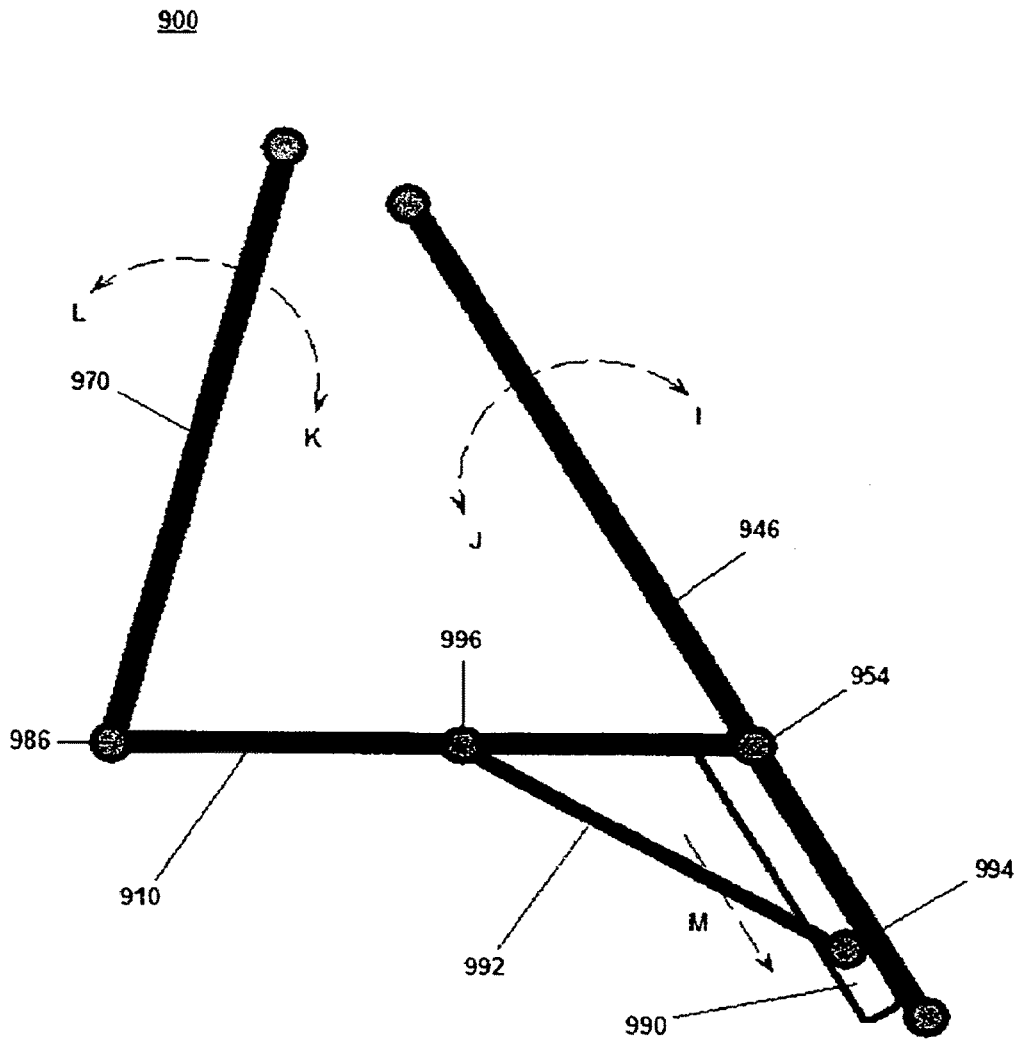
FIG. 9 illustrates a side view of a second configuration of a lower portion of the exemplary alternative embodiment of a man-portable integrated and unitary platform system segment shown in FIG. 7 in transition between a transport (stowed) configuration and an operating (open) configuration according to this disclosure.

FIG. 9 illustrates a side view of a second configuration 900 of a lower portion of the exemplary alternative embodiment of a man-portable integrated and unitary platform system segment shown in FIG. 7 in transition between a transport (stowed) configuration and an operating (open) configuration according to this disclosure.

As with the configuration shown in FIG. 8, the second configuration 900 may allow the man-portable integrated and unitary platform system segment to be folded and unfolded as shown in FIG. 9, and again upper portions of the extended platform hanging hook components, which may be in a configuration to extend telescopically from respective lower upright hanger components, are omitted in FIG. 9 for clarity.

The man-portable integrated and unitary platform system segment may be unfolded and folded by rotating, for example, the lower upright hanger component 946 respectively in directions I or J around the articulated mechanical joint 954 with respect to the framed platform element 910, as appropriate. In a similar manner, the railing upright 970 may be folded and unfolded by rotating it in directions K and L around the articulated mechanical joint 986 with respect to the framed platform element 810, as appropriate.

The lower upright hanger component 946 may be configured with an integral slot-type structure 990 that may be engaged by a slidable structural component 994 at one and of a support leg 992. The other end of the support leg 992 may be engaged with a lateral side frame component of the framed platform element 910 by means of an interconnecting structure 996, which may be in the form of another articulated mechanical joint The support leg 992 may be appropriately, or adjustably, sized to abut an end of the integral slot-type structure 990, after translating in direction. M as the lower upright hanger component 946 is unfolded in direction I with respect to the framed platform element 910. As with the configuration in FIG. 8, the configuration shown in FIG. 9 also is intended to reduce a number of "loose" pieces. In embodiments, a similar support structure may be appropriately configured in which the support leg 992 may be configured to engage a similar integral slot-type structure from a position above the framed platform element 910 in a configuration as a hanging component rather than a support leg.

Figure 10:
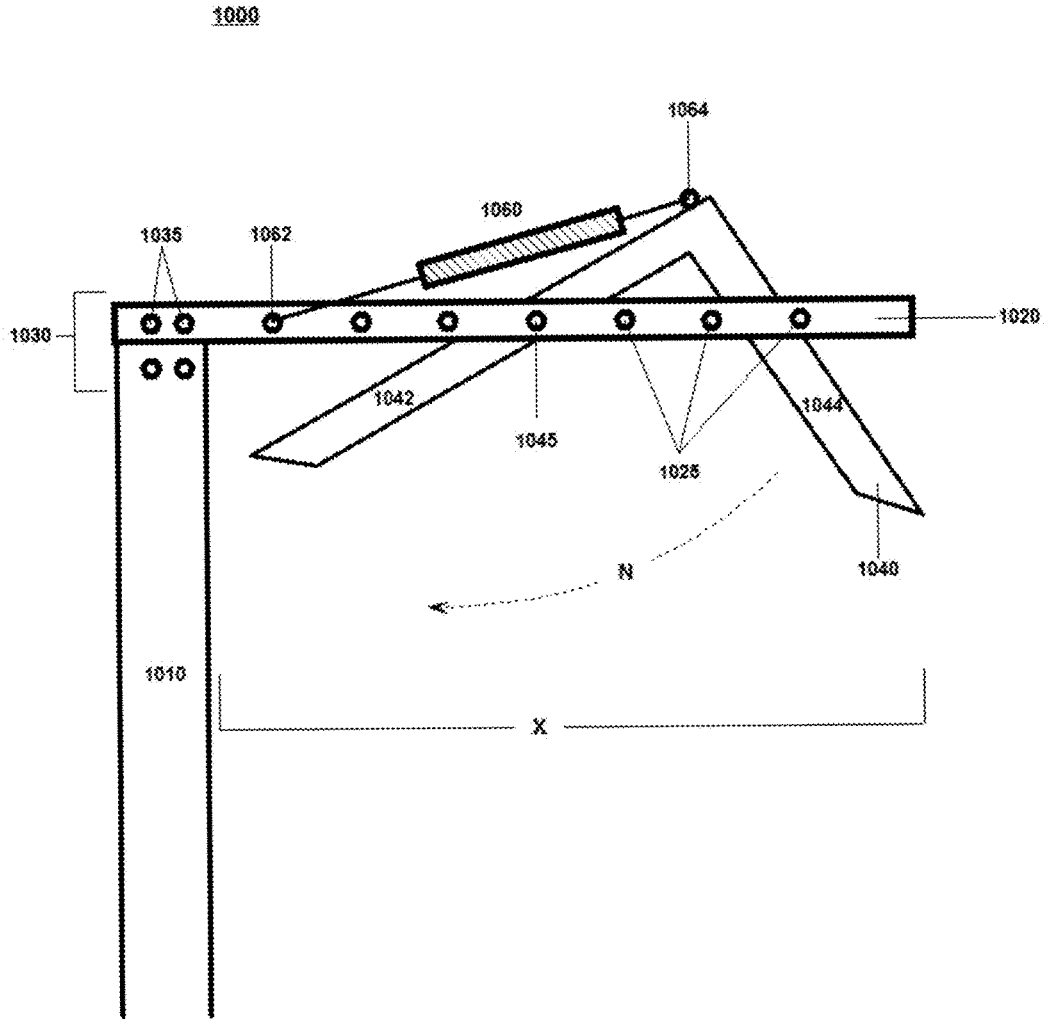
FIG. 10 illustrates a side view of a unique self-attaching hook device component provided for engagement of embodiments of the man-portable integrated and unitary platform system segment with structures of varying thicknesses according to this disclosure.

FIG. 10 illustrates a side view of a unique self-attaching hook device component 1000 provided for positive engagement of embodiments of the man-portable integrated and unitary platform system segment with structures of varying thicknesses according to this disclosure. As shown in FIG. 10, the upper upright hanger component 1010 may be configured to be mechanically engaged at its upper distal end 1030 with a plurality of mechanical engagement elements 1035 in order to securely position a horizontal body portion 1020 of the unique self-attaching hook device component to the upper upright hanger component 1010. The depicted configuration may be accomplished prior to deployment of the man-portable integrated and unitary platform system segment to the field for use, or otherwise may be accomplished on site, once fielded.

In embodiments, the horizontal portion 1020 may come in varying lengths in order to accommodate wide latitude in thickness of structures to which the man-portable integrated and unitary platform system segment may be engaged. In embodiments, the horizontal portion 1020 may be a one piece integral structure. In other embodiments, the horizontal portion 1020 may comprise a multi-part structure including, for example, an intervening structure that may be provided as a first horizontal portion permanently configured to the upper upright hanger component 1010, and a second horizontal portion in a configuration such as that shown as element 1020 in FIG. 10, that may be separately configured in a manner to cooperatively and positively engage the first horizontal portion.

The horizontal portion 1020 may include a plurality of engagement accommodations 1025 by which a hook assembly 1040 may be selectively mechanically engaged with the horizontal portion 1020 at, for example, a particularly selected engagement point 1045. Mechanical engagement of the hook assembly 1040 with the horizontal portion 1020 at the engagement point 1045 may be according to any known mechanical interconnecting means. Again here, if a thickness of the structure to which the man-portable integrated and unitary platform system segment is to be engaged is known, the hook assembly 1040 may be pre-configured in attachment to the horizontal portion 1020. Otherwise, field configuration of these elements together remains an option. In embodiments, an engaging inner surface of the hook assembly 1040, either at a vertical jaw portion 1044, or at a horizontal engaging portion 1042, may include protrusions, which may appear in the form of teeth, to more positively engage the structure.

In embodiments, a spring or piston-type structure 1060 may be provided and anchored at one end to the horizontal portion 1020 at a particular anchor point 1062 that may be in a form of one or more of the plurality of engagement accommodations 1025, and at an other end to an anchoring point 1064 on the hook assembly 1040 substantially in the manner shown. The spring or piston-type structure 1060 may be usable to hold a horizontal opening X between "vertical" surfaces open as wide as possible prior to engagement with the structure. At engagement, when the man-portable integrated and unitary platform system segment is lowered onto a sill of the structure in the manner shown in FIG. 2, the horizontal engaging portion 1042 may act as a lever to cause the hook assembly 1040, to be rotated in direction N for engagement with the structure, and to particularly cause the vertical jaw portion 1044 to positively engage the structure. In embodiments, prior to engagement, the horizontal engaging portion 1042 may be aligned with the horizontal portion 1020 and caused to move linearly in a direction similar to N to cause the vertical jaw portion 1044 to otherwise positively engage the structure.

The above-described exemplary systems and methods reference certain conventional and/or known physical and mechanical components to provide a brief, general description of suitable structures and operating environments in which the subject matter of this disclosure may be implemented for familiarity and ease of understanding. No materials for the construction of the various components are specified such that materials may be selected for optimal employment with the objectives of light overall weights and significant structural integrity in a deployed operating configuration attached to a structure.

Those skilled in the art will appreciate that other embodiments of the disclosed subject matter may be practiced with structures of many different configurations. Embodiments according to this disclosure may be practiced in various working environments.

The exemplary depicted sequence of executable instructions (or method steps) represents one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 6, except where execution of a particular method step is a necessary precondition to execution of any other method step. Not all of the steps of the method depicted in FIG. 6 need be executed by any system according to this disclosure to implement embodiments of the disclosed schemes.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

We claim:

1. An integrated platform system, comprising:

a base platform segment comprising a support area configured to support users and materials in operation;

a pair of multi-element hanger components movably attached by respective attaching components substantially at corners of the base platform segment, the pair of multi-element hanger components being configured to support the base platform segment in operation, each of the pair of multi-element hanger components comprising:

a lower extended element movably attached to the base platform segment via the respective attaching component; and an upper extended element movably attached to the lower extended element via a mechanical joint element, the mechanical joint element allowing freedom of movement between the lower extended element and the upper extended element for folding the lower extended element and the upper extended element with respect to each other; and a pair of supporting legs, each of the supporting legs having a first end and a second end, the first end of the each of the supporting legs being slidably engaged with one of the base platform segment and a respective one of the pair of multi-element banger components and the second end of the each of the supporting legs being engaged at a fixed point on the other of the base platform segment and a respective one of the pair of multi-element hanger components, the pair of supporting legs cooperating to support the base platform segment in operation, the pair of multi-element hanger components being rotatable about the respective attaching components between a first stowed position and a second operating position, the first stowed position provided for securing the pair of multi-element hanger components with a principal longitudinal axis of the pair of multi-element hanger components substantially parallel to a plane of the base platform segment, and the second operating position orienting the principal longitudinal axis of the pair of multi-element hanger components substantially orthogonally to the plane of the base platform segment, the upper extended element further comprising a hanger hook element positioned at a distal end of the upper extended element, the hanger hook element comprising:

a first structural member configured to extend substantially orthogonally to a longitudinal axis of the upper extended element; and a second structural member configured to movably engage the first structural member, the second structural member having a first portion and a second portion arranged substantially orthogonally to each other, the second structural member being arranged such that, in operation, the first portion engages a structure which substantially aligns with the first structural member in a manner that causes the second portion to pivotally close a gap formed between the upper extended element and the second portion of the second structural member substantially aligning the second structural member with the longitudinal axis of the upper extended element, and an elastic component biasing the second structural member towards opening the gap, in which opening the gap increases a length of the gap formed between the upper extended element and the second portion of the second structural member at least at a distal end of the second structural member.

2. The system of claim 1, further comprising a sliding slot structure on the one of the base platform segment and the lower extended element of the respective one of the pair of multi-element hanger components, the first end of each of the supporting legs being configured to mechanically engage the sliding support structure.

3. The system of claim 2, the first end of each of the supporting legs abutting an end of the sliding support structure in the second operating position to support the base platform segment in operation.

4. The system of claim 3, the sliding support structure being affixed to one of an underside of the base platform segment and an extended portion of the lower extended element of the respective one of the pair of multi-element hanger components extending below the base platform segment in the second operating position.

5. The system of claim 1, further comprising an engaging portion by which the second end of each supporting leg engages the fixed point on the other of the base platform segment and the respective one of the pair of multi-element hanger components, the engaging portion allowing rotational engagement between each supporting leg and the other of the base platform segment and the respective one of the pair of multi-element hanger components.

6. The system of claim 1, the first structural member of the hanger hook element being configured to mechanically engage the distal end of the upper extended element.

7. The system of claim 1, wherein:

the respective attaching components are arranged substantially at opposite ends of a first edge of the base platform segment, the system further comprises a railing component including a first railing member movably attached by a separate respective attaching component positioned at a first end of the first railing member to attach the first end of the first railing member to an end of a second edge of the base platform segment, the second edge being opposite and substantially parallel with the first edge, the first railing member being rotatable about the separate respective attaching component between the first stowed position and the second operating position.

8. The system of claim 7, the railing component further comprising a second railing member having a first end and a second end, the first end of the second railing member being configured to mechanically attach to a second end of the first railing member and the second of the second railing member being configured to mechanically attach to the mechanical joint element between the lower extended element and the upper extended element of one of the multi-element hanger components when the first railing member is extended in the second operating position.

* * * * *